US005962081A

United States Patent [19]

Öhman et al.

[11] Patent Number: 5,962,081

[45] Date of Patent: Oct. 5, 1999

[54] METHOD FOR THE MANUFACTURE OF A MEMBRANE-CONTAINING MICROSTRUCTURE

[75] Inventors: Ove Öhman, Uppsala; Christian Vieider, Sollentuna, both of Sweden

[73] Assignee: Pharmacia Biotech AB, Uppsala, Sweden

[21] Appl. No.: 08/945,855

[22] PCT Filed: Jun. 17, 1996

[86] PCT No.: PCT/SE96/00789

§ 371 Date: Nov. 7, 1997

§ 102(e) Date: Nov. 7, 1997

[87] PCT Pub. No.: WO97/01055

PCT Pub. Date: Jan. 9, 1997

[30] Foreign Application Priority Data

Jun. 21, 1995 [SE] Sweden ..... 9502258

[51] Int. Cl.[6] ..... B05D 3/00

[52] U.S. Cl. ..... 427/534; 216/2; 216/39; 216/51; 216/94; 216/97; 427/154; 427/240; 427/287; 427/309; 427/535; 427/555

[58] Field of Search ..... 427/300, 282, 427/272, 230, 154, 97, 105, 309, 534, 535, 555, 240, 287, 290, 271; 216/39, 94, 97, 51, 2

[56] References Cited

U.S. PATENT DOCUMENTS

| | | | |
|---|---|---|---|
| 3,860,448 | 1/1975 | Konantz et al. | 427/300 |
| 3,895,135 | 7/1975 | Hofer | 427/154 |
| 3,951,701 | 4/1976 | Csillag | 427/282 |
| 4,103,073 | 7/1978 | McAlear et al. | 427/282 |
| 4,536,421 | 8/1985 | Matsuzawa et al. | 427/282 |
| 4,581,624 | 4/1986 | O'Connor | 357/26 |
| 4,743,462 | 5/1988 | Radzavich et al. | 427/300 |
| 4,869,282 | 9/1989 | Sittler et al. | 137/15 |
| 4,884,337 | 12/1989 | Choiski | 427/97 |
| 4,988,403 | 1/1991 | Matuo | 156/643 |
| 5,277,929 | 1/1994 | Seki et al. | 427/97 |
| 5,313,264 | 5/1994 | Ivarsson et al. | 356/73 |
| 5,334,342 | 8/1994 | Harket et al. | 427/249 |
| 5,454,928 | 10/1995 | Rogers et al. | 427/97 |
| 5,593,130 | 1/1997 | Hansson et al. | 251/61.1 |
| 5,658,710 | 8/1997 | Neukermans | 427/249 |

FOREIGN PATENT DOCUMENTS 5 01713 C2 5/1995 Sweden .

OTHER PUBLICATIONS

H. Elderstig et al., Sensors and Actuators A 46–47 (1995) 95–97 (no month).

*Primary Examiner*—Diana Dudash
*Attorney, Agent, or Firm*—Birch, Stewart, Kolash & Birch, LLP

[57] ABSTRACT

A method for the manufacture of a microstructure having a top face and a bottom face, at least one hole or cavity therein extending from the top face to the bottom face, and a polymer membrane which extends over a bottom opening of said hole or cavity, which method comprises the steps of: providing a substrate body having said top and bottom faces, optionally forming at least part of said at least one hole or cavity in the substrate body, providing a membrane support at the bottom face opening of said at least one hole or cavity, depositing a layer of polymer material onto the bottom face of said substrate body against said membrane support, if required, completing the formation of the at least one hole or cavity, and, if not done in this step, selectively removing said membrane support to bare said polymer membrane over the bottom opening of the at least one hole or cavity.

18 Claims, 4 Drawing Sheets

METHOD FOR THE MANUFACTURE OF A MEMBRANE-CONTAINING MICROSTRUCTURE

The present invention relates to a novel method for manufacturing a microstructure comprising an elastic membrane.

WO 90/05295 discloses an optical biosensor system wherein a sample solution containing biomolecules is passed over a sensing surface having immobilized thereon ligands specific for the biomolecules. Binding of the biomolecules to the sensing surface of a sensor chip is detected by surface plasmon resonance spectroscopy (SPRS). A microfluidic system comprising channels and valves supplies a controlled sample flow to the sensor surface, allowing real time kinetic analysis at the sensor surface.

The microfluidic system is based upon pneumatically controlled valves with a thin elastomer as membrane and comprises two assembled plates, e.g. of plastic, one of the plates having fluid channels formed by high precision moulding in an elastomer layer, such as silicone rubber, applied to one face thereof. The other plate has air channels for pneumatic actuation formed therein which are separated from the fluid channels in the other plate by an elastomer membrane, such as silicone rubber, applied to the plate surface. The integrated valves formed have a low dead volume, low pressure drop and a large opening gap minimizing particle problems. Such a microfluidic system constructed from polystyrene and silicone is included in a commercial biosensor system, BIAcore™, marketed by Pharmacia Biosensor AB, Uppsala, Sweden.

The method of manufacturing this microfluidic system, based upon high precision moulding, however, on the one hand, puts a limit to the miniaturization degree, and, on the other hand, makes it time-consuming and expensive to change the configuration of the system.

Elderstig, H., et al., Sensors and Actuators A46: 95–97, 1995 discloses the manufacture of a capacitive pressure sensor by surface micromachining. On a substrate having a silicon oxide layer and a superposed silicon nitride layer, a continuous cavity is etched in the oxide layer through a large amount of small holes in the nitride layer. A polyimide film is then spun on top of the perforated membrane to close the holes.

The object of the present invention is to provide a method which simplifies the fabrication of and permits further miniaturization of microfluidic structures as well as other structures comprising a flexible polymer membrane.

According to the present invention this object is achieved by integrating a polymer deposition process into a fabrication sequence which comprises micromachining of etchable substrates.

In its broadest aspect, the present invention therefore provides a method for the manufacture of a microstructure having a top face and a bottom face, at least one hole or cavity therein extending from the top face to the bottom face, and a polymer membrane which extends over a bottom opening of said hole or cavity, which method comprises the steps of:

- providing a substrate body having said top and bottom faces,
- optionally forming at least part of said at least one hole or cavity in the substrate body,
- providing a membrane support at the bottom face opening of said at least one hole or cavity,
- depositing a layer of polymer material onto the bottom face of said substrate body against said membrane support,

- if required, completing the formation of the at least one hole or cavity, and, if not done in this step,
- selectively removing said membrane support to bare said polymer membrane over the bottom opening of the at least one hole or cavity.

The substrate body is preferably of etchable material and is advantageously plate- or disk-shaped. While silicon is the preferred substrate material, glass or quartz may also be contemplated for the purposes of the invention. The substrate body may also be a composite material, such as a silicon plate covered by one or more layers of another etchable material or materials, e.g. silicon nitride, silicon dioxide etc. Preferred polymer materials are elastomers, such as silicone rubber and polyimide.

The formation of the holes or cavities is preferably effected by etching, optionally from two sides, but partial or even complete formation of the holes may also be performed by other techniques, such as laser drilling.

Deposition of the polymer layer may be performed by spin deposition, which is currently preferred, but also other polymer deposition techniques may be contemplated, such as areosol deposition, dip coating etc.

The application of a membrane support in the form of a sacrificial support layer for the polymer may be required before depositing the polymer, since (i) application of the polymer directly to a completed through-hole or -holes will result in the polymer flowing into and partially filling the hole rather than forming a membrane over it, and (ii) in the case of hole etching, for conventional silicon etching agents, such as KOH and BHF (buffered hydrogen fluoride), a polymer membrane which is applied before the hole etching procedure is completed will lose its adherence to the substrate during the etch. Such a sacrificial support layer may be applied before or after etching the hole or holes.

When the sacrificial support layer is applied before the hole etch, it may be a layer of a material which is not affected by the hole etch, for example a silicon oxide or nitride layer applied to the hole bottom side of the substrate before the etch. After etching of the hole(s) and deposition of the polymer, the sacrificial layer is then selectively etched away.

In the case of applying the sacrificial support layer after the formation of the hole or holes, the hole bottom side of the substrate is first covered by a protective layer. In case the hole or holes are formed by etching, such a protective layer may be a layer of a material which is not affected by the hole etch, such as, for example, a silicon oxide or nitride layer, thereby leaving the etched hole or holes covered by this protective layer. A selectively removable sacrificial support layer, such as a photoresist, is then applied to the open hole side of the substrate, thereby filling the bottom of the holes, whereupon the protective layer is removed and the polymer layer is deposited against the bared substrate face including the filled hole bottom(s). The support layer can then be removed without affecting the adherence of the elastomer layer to the substrate.

With other silicon etching agents, such as RIE (Reactive Ion Etching), the adherence of the polymer membrane may, on the other hand, not be lost, and the provision of a special sacrificial membrane support layer may therefore not be necessary, but the substrate material itself may serve as membrane support. In this case, the polymer membrane layer is applied to the substrate and the etching of the hole or holes is then effected up to the polymer membrane.

Another way of avoiding the use of a sacrificial layer is to etch small pores (of Angström size) in the silicon substrate, either only in the regions where the membrane holes are to be etched, or optionally in the whole silicon plate. The polymer membrane is then deposited, and the desired holes are etched with a mild etch, such as weak KOH.

By combining polymer spin deposition methods with semiconductor manufacturing technology as described above, a wide variety of polymer membrane-containing microstructures may be conveniently produced, such as for example, valves, pressure sensors, pumps, semipermeable sensor membranes, etc.

In the following, the invention will be described in more detail with regard to some specific non-limiting embodiments, reference being made to the accompanying drawings, wherein.

The chemical methods to which it will be referred to below are well-known from inter alia the manufacture of integrated circuits (IC) and will therefore not be described in further detail. It may, however, be mentioned that two basal etching phenomenons are used in micromachining, i.e. that (i) depending on substrate and etching agent, the etch may be dependent on the crystal direction or not, and (ii) the etch may be selective with regard to a specific material.

In a crystal direction dependent etch in a crystalline material, so-called anisotropic etch, etching is effected up to an atomic plane (111), which gives an extremely smooth surface. In a so-called isotropic etch, on the other hand, the etch is independent of the crystal direction.

The above-mentioned selectivity is based upon differences in the etch rates between different materials for a particular etching agent. Thus, for the two materials silicon and silicon dioxide, for example, etching with hydrogen fluoride takes place (isotropically) about 1,000 to about 10,000 times faster in silicon dioxide than in silicon. Inversely, sodium hydroxide gives an anisotropic etch of silicon that is about 100 times more efficient than for silicon dioxide, while a mixture of hydrogen fluoride and nitric acid gives a selective isotropic etch of silicon that is about 10 times faster than in silicon dioxide.

Figure 1:
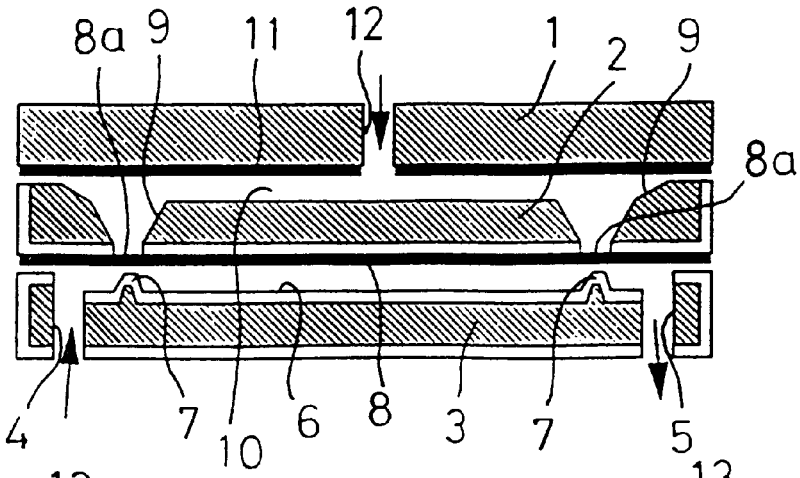
FIG. 1 is a schematic exploded sectional view of one embodiment of a membrane valve.

Now with reference to the Figures, FIG. 1 illustrates a membrane valve consisting of three stacked silicon wafers, i.e. an upper silicon wafer 1, a middle silicon wafer 2 and a lower silicon wafer 3.

The lower wafer 3 has a fluid inlet 4 and a fluid outlet 5 connected via a fluid channel 6 with two valve seats 7 interrupting the flow. The fluid channel 6 may, for example, have a width of about 200 $\mu$m and a depth of about 50 $\mu$m, and the valve seats 7 may have length of about 10 $\mu$m.

The middle wafer 2 covers the fluid channel and has an elastomer layer 8, e.g. silicone rubber, applied to its underside. Right above each valve seat 7, the silicone layer extends over a hole or recess 9 in the wafer such that a free membrane 8*a* is formed above each valve seat. Recesses 9 are connected via a channel 10.

The upper wafer 1, which also has an elastomer layer 11, e.g. silicone rubber, applied to its underside, functions as a lid and has a bore 12 for connection to an air pressure control means.

It is readily seen that by controlling the air pressure in the channel 10 of the middle wafer 2, and thereby actuating the elastomer membranes 8*a* above the valve seats 7, the flow through the valve may be accurately controlled.

A process sequence for manufacturing the middle wafer 2 is shown in FIGS. 2A to 2F.

Figure 2A:
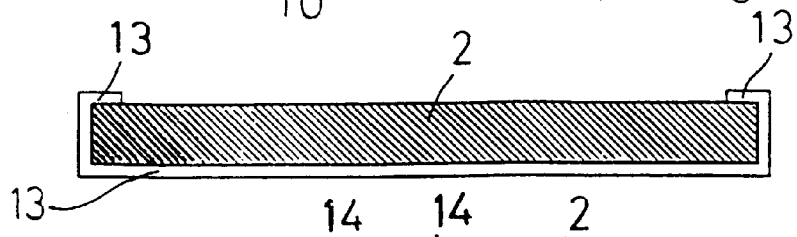
FIGS. 2A, 2B, 2C, 2D, 2E and 2F are schematic sectional views of a processed silicon substrate at different stages in one process embodiment for the production of a part of the membrane valve in FIG. 1.

With reference first to FIG. 2A, a double-polished silicon wafer 2 is oxidized to form an oxide layer 13 thereon. After patterning the air channel 10 (FIG. 1), the oxide layer is etched.

Figure 2B:
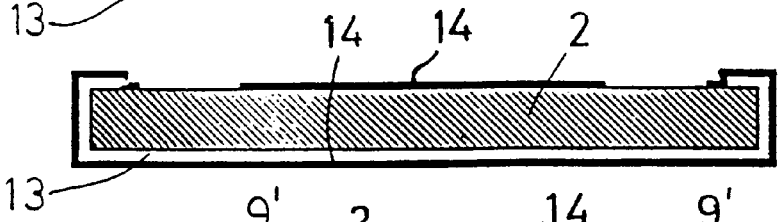

Silicon nitride deposition is then performed to form a nitride layer 14 as illustrated in FIG. 2B. The membrane holes 9 (FIG. 1) are patterned and the nitride layer 14 is etched to form a nitride mask with the desired hole pattern.

Figure 2C:
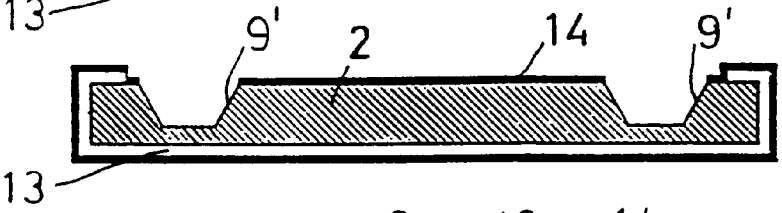

A deep anisotropic silicon etch is then effected, e.g. with KOH (30%), through the nitride mask, resulting in partial membrane holes 9', as shown in FIG. 2C.

Figure 2D:
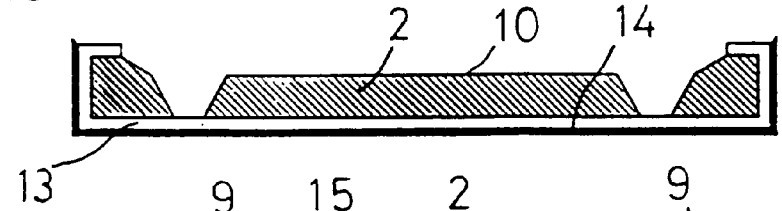

After a selective etch of the nitride mask 14, a selective silicon etch is performed, e.g. with KOH-IPA, to complete the opening of the membrane holes 9 and simultaneously etch the air channel 10. The resulting wafer with only the thin oxide/nitride layers 13, 14 covering the membrane holes 9 is illustrated in FIG. 2D.

Figure 2E:
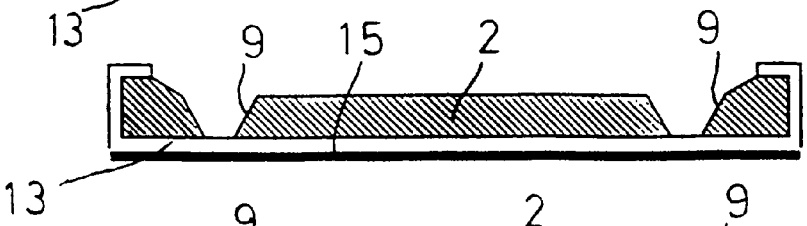

With reference now to FIG. 2E, the remaining nitride layer 14 on the sides and bottom of the wafer 2 is then selectively etched, and a thin layer, for example about 25 $\mu$m thickness, of an elastomer, e.g. a two-component silicone elastomer 15, is applied by spin-deposition.

Figure 2F:
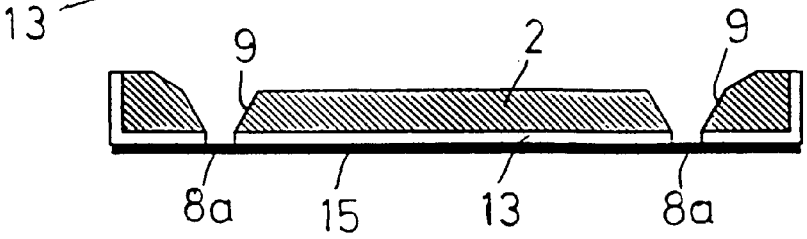

Finally, the bared oxide 13 at the bottom of holes 9 is selectively etched by an agent that does not affect the elastomer 15, such as an RIE plasma etch. The completed middle wafer 2 is shown in FIG. 2F.

The upper silicon wafer 1 of the valve in FIG. 1 is produced by spin deposition of the elastomer layer 11 to a silicon wafer, and laser boring of the hole 12.

The lower silicon wafer 3 of the valve is prepared by first oxidizing a silicon wafer, patterning the fluid channel 6, and etching the patterned oxide layer to form an oxide mask with the desired channel pattern. A selective silicon etch is then performed through the oxide mask, e.g. with KOH-IPA, to form the fluid channel 6. After laser drilling of the fluid inlet and outlet holes 4 and 5, fluid channel 6 is oxidized.

The valve is completed by assembly of the three wafers 1–3 and mounting thereof in a holder (not shown).

It is readily seen that a plurality of such valves may be provided in a single silicon wafer. The number of valves that may be contained in the wafer, i.e. the packing degree, for the above described silicon etching procedures is mainly determined by the thickness of the wafer (due to the tapering configuration of the etched holes). For example, with a 200 $\mu$m thick silicon wafer, each valve would occupy an area of at least 0.5×0.5 mm, permitting a packing of up to about 280 valves/cm$^2$.

In the case of the silicon being etched with RIE, however, completely vertical hole sides may be obtained, permitting a packing degree of about 1000 valves/cm$^2$ for 200×200 $\mu$m membranes.

If desired, the attachment of the elastomer membrane to the substrate in the valve area may be improved by providing a fixing groove for the membrane in the substrate surface, as illustrated in FIGS. 3A to 3D.

Figure 3A:
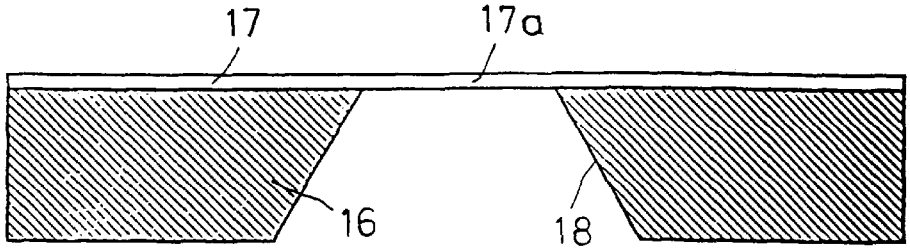
FIGS. 3A, 3B, 3C and 3D are schematic partial sectional views of a processed silicon substrate at different stages in a process embodiment for the production of a membrane valve member with a securing groove for the membrane.

FIG. 3A shows a silicon wafer 16 with an oxide layer 17 forming a sacrificial membrane 17*a* over a valve through-hole 18 in the wafer 16. An annular edge attachment, or fixing groove, is patterned on the oxide layer 17 around the opening 18, whereupon the bared oxide parts are etched away.

Figure 3B:
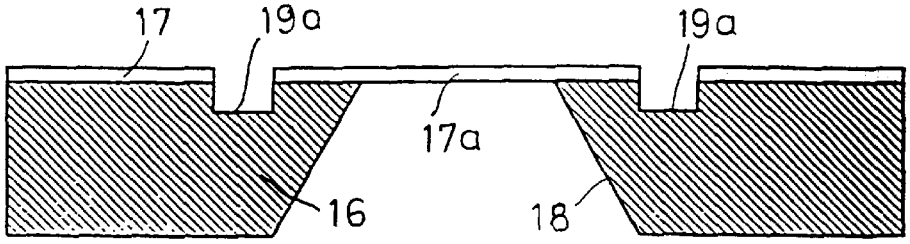

The silicon is then dry-etched at 19*a* to a depth of, say, about 10 μm, as illustrated in FIG. 3B. By then subjecting the silicon to an anisotropic KOH etch to a depth of about 10 μm, negative sides of the etched groove may be obtained.

Figure 3C:
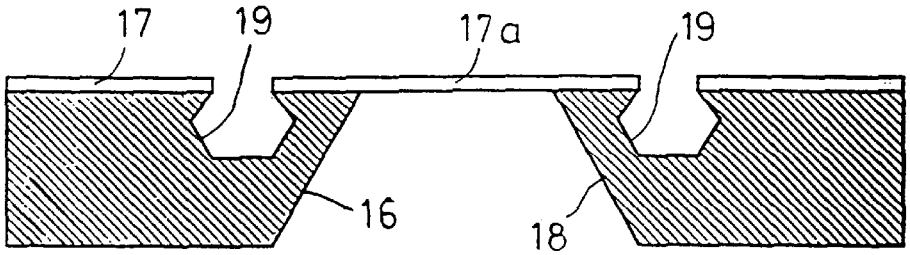
Figure 3D:
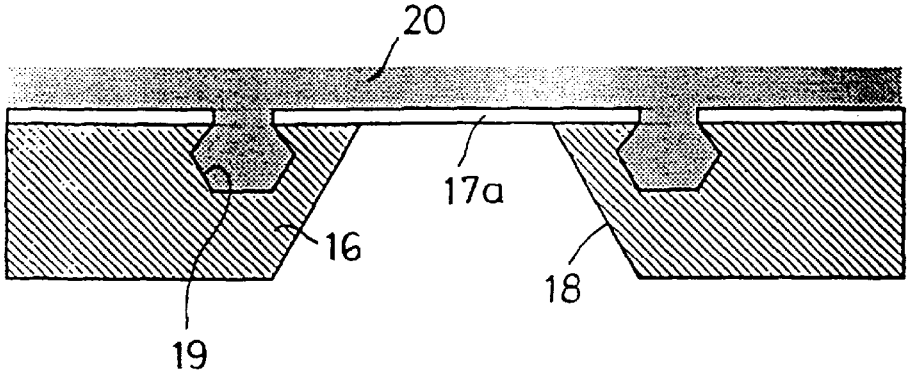

FIG. 3C shows the completed groove 19, which has a width of about twice the depth. An elastomer membrane 20, such as silicone rubber, is then spin deposited onto the substrate surface. A first deposition at a high rotation speed provides for good filling of the groove 19, and a subsequent deposition at a low rotation speed gives a smooth surface. The sacrificial oxide membrane is then etched away as described previously in connection with FIGS. 2A to 2F.

FIGS. 4A to 4F illustrate an alternative way of providing a sacrificial membrane for initially supporting the elastomer membrane.

Figure 4A:
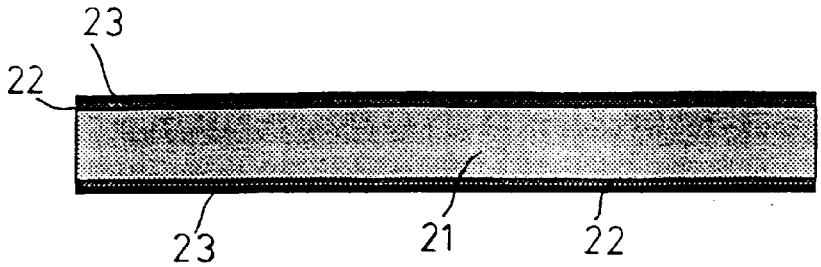
FIGS. 4A, 4B, 4C, 4D, 4E and 4F are schematic partial sectional views of a processed silicon substrate at different stages in an alternative process embodiment for the production of the membrane valve member in FIG. 1.

A silicon wafer 21 is coated with an oxide layer 22 and a superposed nitride layer 23, as shown in FIG. 4A.

Figure 4B:
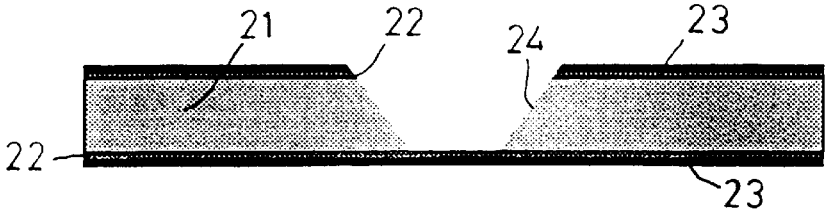

A hole 24 is then opened in the upper oxide/nitride layers and the silicon wafer is etched straight through down to the oxide, as illustrated in FIG. 4B.

Figure 4C:
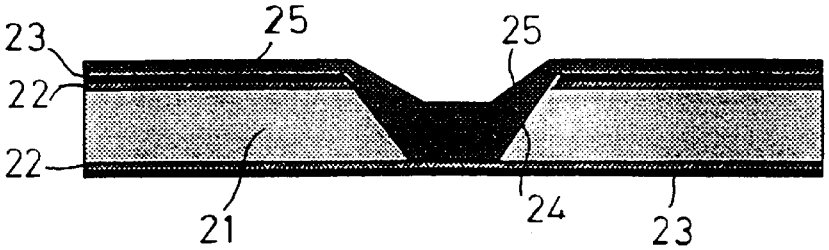

A thick layer of positive photoresist 25 is then spun onto the etched face of the wafer, partially filling the hole 24 as shown in FIG. 4C.

Figure 4D:
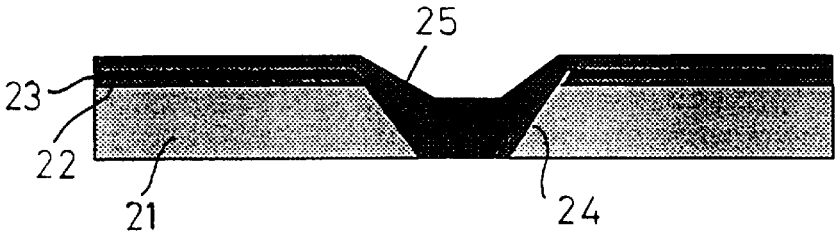

The lower oxide/nitride layers 22, 23 are subsequently etched away by a dry etch, and the resulting wafer is shown in FIG. 4D.

Figure 4E:
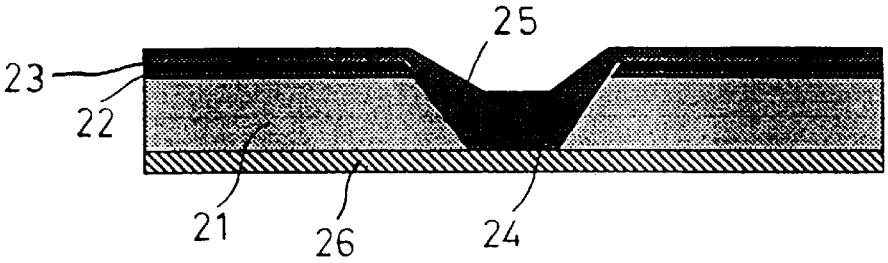

An elastomer layer 26, such as silicone rubber, is then spin deposited to the lower face of the wafer to the desired thickness, e.g. about 50 μm, as illustrated in FIG. 4E.

Figure 4F:
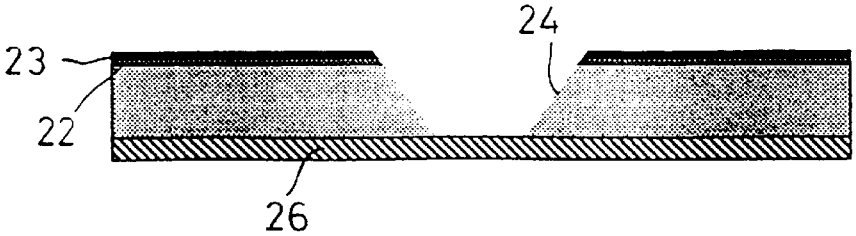

The positive photoresist 25 is then removed, e.g. with acetone. The completed wafer is shown in FIG. 4F.

In the embodiments above, sacrificial membranes of oxide and photoresist, respectively, have been described. To improve the strength of the sacrificial membrane, however, a combined oxide/nitride sacrificial membrane may be used, i.e. in the process embodiment described above with reference to FIGS. 2A–2F, the nitride need not be etched away before the elastomer deposition. Alternatively, a sacrificial membrane structure consisting of a polysilicon layer sandwiched between two oxide layers and an outer protective nitride layer may be used. As still another alternative, an etch-resistent metal layer may be used as the sacrificial membrane.

In a variation of the process embodiments described above with reference to FIGS. 2A to 2F and 4A to 4F, respectively, a major part, say about ¾, of the depth of holes 9 and 24, respectively, may be preformed by laser-drilling from the top face of the chip, only the remaining hole portion then being etched. Not only will such a procedure speed up the manufacturing procedure to a substantial degree, provided that the number of holes per wafer is relatively low (<1000), but will also permit a still higher packing degree.

Figure 5A:
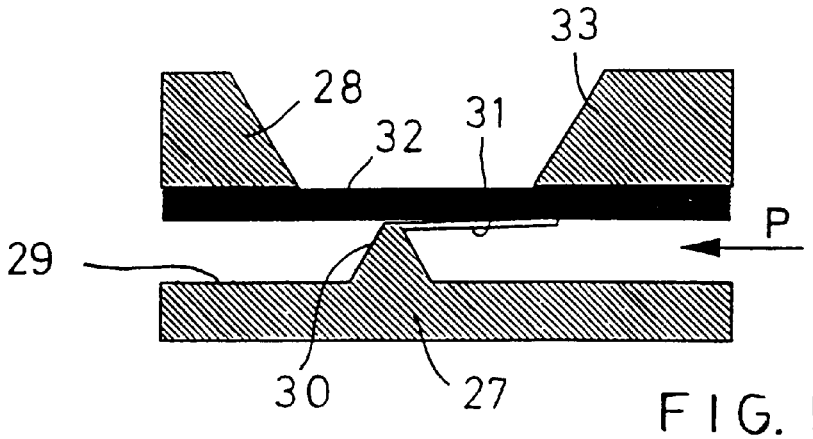
FIGS. 5A and 5B are schematic partial sectional views of a one-way valve.
Figure 5B:
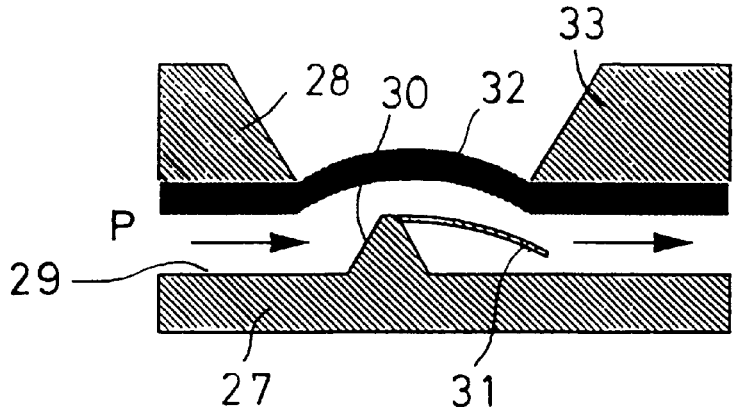

A non-return valve produced by the method of the invention is illustrated in FIGS. 5A and 5B. The valve consists of two silicon plates 27 and 28. The lower silicon plate 27 has a fluid channel 29 with a valve seat 30 therein. The valve seat 30 includes a free-etched flexible tongue 31. The upper silicon plate 28 has an elastomer membrane 32 extending over an etched trough-hole 33 in the plate and may be produced as described above with regard to FIGS. 2A to 2F.

As is readily understood, a fluid flow from the right is blocked (FIG. 5A), whereas a fluid flow from the left may be made to pass by actuation of the membrane 32.

Figure 6A:
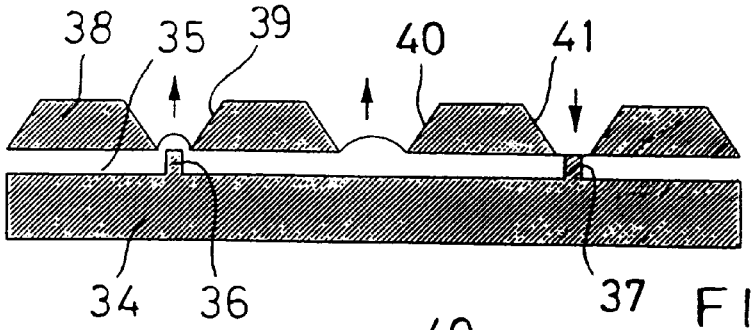
FIGS. 6A and 6B are schematic partial sectional views of a membrane pump.
Figure 6B:
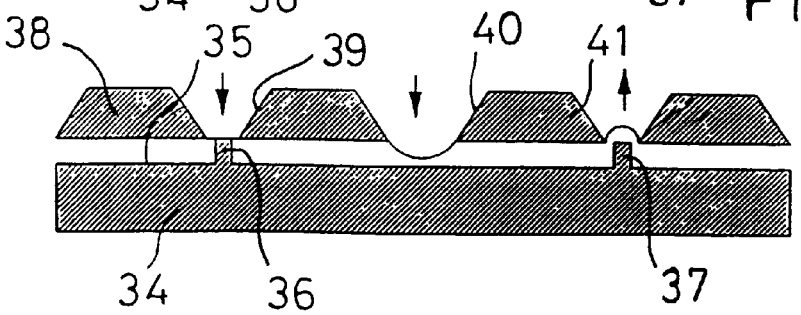

FIGS. 6A and 6B show a membrane pump produced utilizing the method of the invention. The pump consists of a lower silicon plate 34 having a fluid channel 35 with two valve seats 36 and 37 therein, and an upper silicon plate 38, produced as described above with reference to FIGS. 2A to 2F. The upper plate 38 comprises three silicone membrane-covered through-holes 39, 40 and 41, each connected to a controlled pressurized air source. The membrane-covered holes 39 and 41 are located just above the valve seats 36 and 37 to form membrane valves therewith. The third membrane-covered hole 40 is larger and functions as a fluid actuating member.

It is readily realized that by simultaneously and individually actuating the three membranes of holes 39, 40 and 41 in the directions indicated by the arrows in FIG. 6A, fluid will enter from the left in the figure into the part of fluid channel 35 located between the valve seats 36 and 37. The fluid will then be pressed out to the right by simultaneously and individually actuating the membranes of holes 39, 40 and 41 in the directions indicated by the arrows in FIG. 6B. In this way, an efficient pumping action is obtained.

The described membrane pump will have a low pressure drop which makes it possible to pump at a high pressure with no leakage in the reverse direction. Since the valves open with a relatively large gap, it will also be possible to pump fairly large particles, which is otherwise a problem with pumps produced by micromachining techniques.

The invention will now be illustrated further by the following non-limiting Example.

EXAMPLE

A silicon wafer of 500 μm thickness was processed by the procedure discussed above in connection with FIGS. 2A to 2F to produce a number of valve plates for use in a membrane valve of the type shown in FIG. 1 as follows.

Etch of Oxide Mask for Air Channel (FIG. 2A)

The wafer was washed and then oxidized to produce an oxide layer of 1.5 μm. A 1.2 μm photoresist layer was then applied to the top face of the wafer, soft-baked for 60 seconds and patterned with a mask corresponding to the desired air channel. The photoresist was then spray developed and hard-baked for 15 min at 110° C. The backside of the wafer was then coated with a 1.5 μm photoresist layer and hard-baked at 110° C. for 10 min. The 1.5 μm oxide layer was wet-etched by BHF (ammonium buffered hydrogen fluoride), whereupon the photoresist was stripped off.

Etch of Nitride Mask for Membrane Holes (FIG. 2B)

Nitride was then deposited to form a 1500 Å nitride layer. A 1.5 μm photoresist layer was applied to the nitride layer, soft-baked and patterned with a mask corresponding to the membrane holes. The photoresist was spray developed and hard-baked at 110° C. for 20 min. The back-side of the wafer was then coated with a 1.5 μm photoresist layer and hard-baked at 110° C. for 10 min.

The bared nitride portions were then dry-etched by RIE (Reactive Ion Etch) down to the silicon substrate, whereupon the photoresist was dry-stripped with an oxygen plasma at 120° C.

Initial Etch of Membrane Holes (FIG. 2C)

After a short oxide etch with hydrogen fluoride 1:10 for 10 seconds, a silicon etch was performed with 30% KOH to a depth of about 420 μm (etch rate about 1.4 μm/min).

Etch of Air Channel and Membrane Holes (FIG. 2D)

1.5 μm photoresist was applied to the back-side of the wafer and hard-baked at 110° C. for 30 min. The remaining front nitride layer was then dry-etched by RIE, followed by dry-stripping of the photoresist with an oxygen plasma at 120° C. A short oxide etch with hydrogen fluoride 1:10 for 10 seconds was performed, immediately followed by a silicon etch with KOH/propanol (2 kg KOH, 6.5 l $H_2O$, 1.5 l propanol) at 80° C. to a depth of about 100 μm (etch rate about 1.1 μm/min), i.e. down to the oxide layer on the back-side of the wafer.

Deposition of Silicone Membrane (FIG. 2E)

The nitride on the back-side of the silicon wafer was then etched away, followed by oxidation to 1.5 μm. After drying at 180° C. for 30 min, a 20 μm layer of a two-component silicone rubber was applied to the oxide layer on the back-side of the wafer by spin-deposition at 2000 rpm for 40 seconds and then cured at 100° C. for 30 min to form a silicone membrane.

Etch of Sacrificial Oxide Membrane (FIG. 2F)

The oxide layer on the back-side of the wafer was removed by a dry oxide etch through the etched holes in the silicon to bare the silicone membrane.

The silicon wafer was finally divided into separate valve plates by sawing.

The invention is, of course, not restricted to the embodiments specifically described above and shown in the drawings, but many modifications and changes may be made within the scope of the general inventive concept as defined in the following claims.

I claim:

1. A method for the manufacture of a microstructure having a top face and a bottom face, at least one hole therein extending from the top face to the bottom face, and a polymer membrane which extends over a bottom opening of said hole, which method comprises the steps of:

a) providing a substrate body (2; 21) having said top and bottom faces, b) forming at most part of said at least one hole (9; 24) in the top face of the substrate body, c) providing a membrane support layer (13; 25)

(i) in said part of said at least one hole formed in step (b) and completing said at least one hole from the bottom face of said substrate body, or (ii) on the bottom face of said substrate body, d) depositing a layer of polymer material onto the bottom face of said substrate body (2; 21) against said membrane support layer (13; 25) to form a polymer membrane (15; 26), e) completing the formation of the at least one hole (9; 24) if step (c) is according to alternative (ii), and f) selectively removing said membrane support layer (13; 25) to bare said polymer membrane (15; 26) over the bottom opening of the at least one hole.

2. The method according to claim 1, wherein the substrate body (2, 21) is of etchable material.

3. The method according to claim 1 or 2, which comprises forming a part of said at least one hole and subsequently applying membrane support layer (25).

4. The method according to claim 3, wherein step (a) comprises providing the substrate body (21) in a form having a protective layer (22; 23) on the bottom face thereof; step (b) comprises etching said part of said at least one hole (24) from the top face of the substrate body to the protective layer (22; 23); and step (c) is according to alternative (i) with completing of said at least one hole by removing said protective layer.

5. The method according to claim 1, wherein step (c) is according to alternative (ii) and step (e) comprises etching said at least one hole to the polymer material layer applied in step (d).

6. The method according to claim 5, wherein the etching is performed by a dry etch.

7. The method according to claim 1, wherein a part of said holes or cavities, are preformed by laser drilling.

8. The method according to claim 1, wherein said substrate body is from silicon, glass or quartz.

9. The method according to claim 8, wherein said substrate is a silicon wafer.

10. The method according to claim 1, wherein said polymer material is an elastomer.

11. The method according to claim 2, wherein said membrane support layer (13) is silicon oxide or silicon nitride or a combination thereof.

12. The method according to claim 3, wherein said membrane support layer (25) is a photoresist material.

13. The method according to claim 1, wherein the deposition of said polymer is performed by spin deposition.

14. The method of claim 6, wherein said dry etching is a reactive ion etch.

15. The method of claim 7, wherein a majority of said holes or cavities are laser etched.

16. The method of claim 10, wherein said elastomer is a silicone rubber.

17. A method for the manufacture of a microstructure having a top face and a bottom face, at least one hole therein extending from the top face to the bottom face, and a polymer membrane which extends over a bottom opening of said hole, which method comprises the steps of:

a) providing a substrate body (2; 21) having said top and bottom faces and having a membrane support layer (13; 25) on the bottom face of said substrate body, b) forming at most part of said at least one hole (9; 24) in the top face of the substrate body, c) depositing a layer of polymer material onto the bottom face of said substrate body (2; 21) against said membrane support layer (13; 25) to form a polymer membrane (15; 26), d) completing the formation of the at least one hole (9; 24) to the layer of polymer material applied in step (c), and e) selectively removing said membrane support layer (13; 25) to bare said polymer membrane (15; 26) over the bottom opening of the at least one hole.

18. The method according to claim 17, wherein step (b) is comprises etching down to said membrane support layer and step (d) comprises removing the membrane support layer to bare the polymer membrane in said at least one hole formed in step (b).

* * * * *